US007140935B2

(12) United States Patent
Futaki

(10) Patent No.: US 7,140,935 B2
(45) Date of Patent: Nov. 28, 2006

(54) SMALL JET PROPULSION WATERCRAFT

(75) Inventor: Yoshiki Futaki, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/967,516

(22) Filed: Oct. 18, 2004

(65) Prior Publication Data

US 2005/0085143 A1 Apr. 21, 2005

(30) Foreign Application Priority Data

Oct. 16, 2003 (JP) ..... 2003-356554

(51) Int. Cl.
*B63H 21/32* (2006.01)

(52) U.S. Cl. ..... 440/89 F; 440/89 J

(58) Field of Classification Search ..... 440/89 R, 440/89 B, 89 C, 89 F, 89 J; 114/55.56
See application file for complete search history.

(56) References Cited

U.S. PATENT DOCUMENTS 5,699,749 A * 12/1997 Yamada et al. ..... 114/55.51
5,921,198 A * 7/1999 Yoshida ..... 114/357
6,551,155 B1 * 4/2003 Lecours et al. ..... 114/55.5
6,855,022 B1 * 2/2005 Matsuda et al. ..... 440/89 R
2004/0194682 A1 * 10/2004 Matsuda ..... 114/55.56
2004/0209533 A1 * 10/2004 Matsuda ..... 440/111

FOREIGN PATENT DOCUMENTS

JP 07-5219 2/1995

* cited by examiner

*Primary Examiner*—Sherman Basinger
(74) *Attorney, Agent, or Firm*—Knobbe, Martens, Olson & Bear, LLP

(57) ABSTRACT

A small jet propulsion watercraft 10 is provided with side wall portions 14*a* and 14*b* formed on both the left and right sides of a stepping platform 13, within which water lock devices 36 and 37 are disposed, respectively. The water lock devices 36 and 37 are connected with connecting pipes 38*a* and 38*b* located below the stepping platform 13. An exhaust pipe 40 is connected to the front end of the water lock device 37, with the exhaust pipe 40 initially extending forward, extending upward and then rearward, and passing above the water lock device 37 within the side wall portion 14*b*, and with its end further extending downward to a position below the stepping platform 13. The water lock devices 36 and 37 are connected with small-diameter pipes 39*a* and 39*b* at a portion lower than where the connecting pipes 38*a* and 38*b* are joined to the water lock devices 36 and 37.

6 Claims, 8 Drawing Sheets

SMALL JET PROPULSION WATERCRAFT

The present application is based on and claims priority under 35 U.S.C. § 119 to Japanese Patent Application No. 2003-356554, filed on Oct. 16, 2003, the entire contents of which are expressly incorporated by reference herein.

BACKGROUND OF THE INVENTIONS

1. Field of the Inventions

The inventions disclosed herein relate to a small jet propulsion watercraft on which an operator typically stands on a platform provided at a rear of the watercraft body (commonly known as "stand-up" type watercraft), and more particularly, to exhaust systems for such watercraft.

2. Description of the Related Art

Typically, stand-up type watercraft include a platform or "foot tray" provided at the rear of its hull for accommodating the operator. A jet pump is typically disposed below the foot tray. The jet pump is usually driven by a small internal combustion engine so as to draw in seawater from a bottom of the watercraft hull and to discharge the water from the stern of the hull, thereby providing thrust to propel the watercraft across a body of water. The engine on such a small jet propulsion watercraft is usually disposed such that its crankshaft extends longitudinally in the fore-to-aft direction of the body.

The engine usually has a plurality of cylinders, each having an intake port and an exhaust port. An intake system is connected to the intake port, and an exhaust system is connected to the exhaust port (see Japanese Patent Publication No. Hei 7-5219).

The exhaust system of this type of small jet propulsion watercraft typically has an exhaust pipe that is joined to the exhaust port of the engine and extends toward the front of the watercraft. An exhaust muffler is usually connected to the exhaust pipe, and a discharge pipe is typically connected to the exhaust muffler to discharge exhaust gas into the atmosphere. The exhaust pipe and the exhaust muffler are disposed inside of an engine chamber within the hull of the watercraft. In other small jet propulsion watercraft, an exhaust system is often includes a water lock device or other similar devices installed in a rear of the hull. In this case, too, most of the exhaust system is installed inside of the engine chamber or another chamber within the hull.

SUMMARY OF THE INVENTION

However, the aforementioned small jet propulsion watercraft has a problem that most of the components of the exhaust system are installed within the engine chamber and less vacant space is available within the engine chamber, resulting in the substantial limitation on the layout of other parts to be installed in the engine chamber. In addition, it is preferable for a small jet propulsion watercraft to construct the exhaust system in a complicated shape winding upward and downward, in order to prevent the intrusion of seawater (which may include water in the sea, lakes and rivers, all of which will be referred to as seawater herein) into the engine from the exhaust system. However, the aforementioned small jet propulsion watercraft has a problem that the intrusion of the seawater cannot be prevented adequately.

In accordance with at least one of the embodiments disclosed herein, a small jet propulsion watercraft includes an engine and a body configured to be operable by an operator riding on a stepping platform provided at a rear of the body. The body includes left and right side wall portions extending upwardly and disposed at both left and right sides of the stepping platform. At least a first water lock device is configured to guide exhaust gas to an exterior of the watercraft from an exhaust port of the engine. The first water lock device is provided within at least one of the left and right side wall portions.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

An embodiment of is described below with reference to the drawings. The embodiments of the various systems disclosed below have particular utility in the environment of use of small personal watercraft, such a the stand-up variety, and therefore are illustrated in connection with such a vehicle. It is contemplated, however, that these systems, together or separately, can be used with other types of vehicles as well, such as, for example, but without limitation, sit-down type watercraft, small jet boats, and other vehicles.

Figure 1:
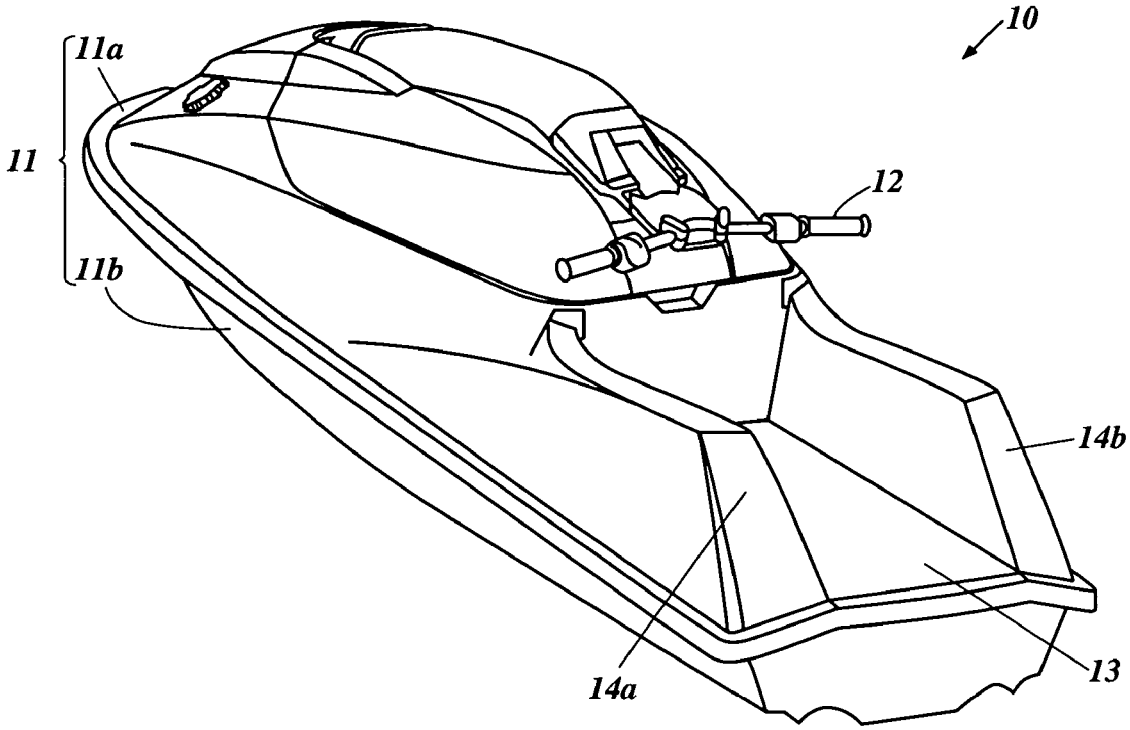
FIG. 1 is a perspective view of a small jet propulsion watercraft according to at least one of the embodiments disclosed herein.
Figure 2:
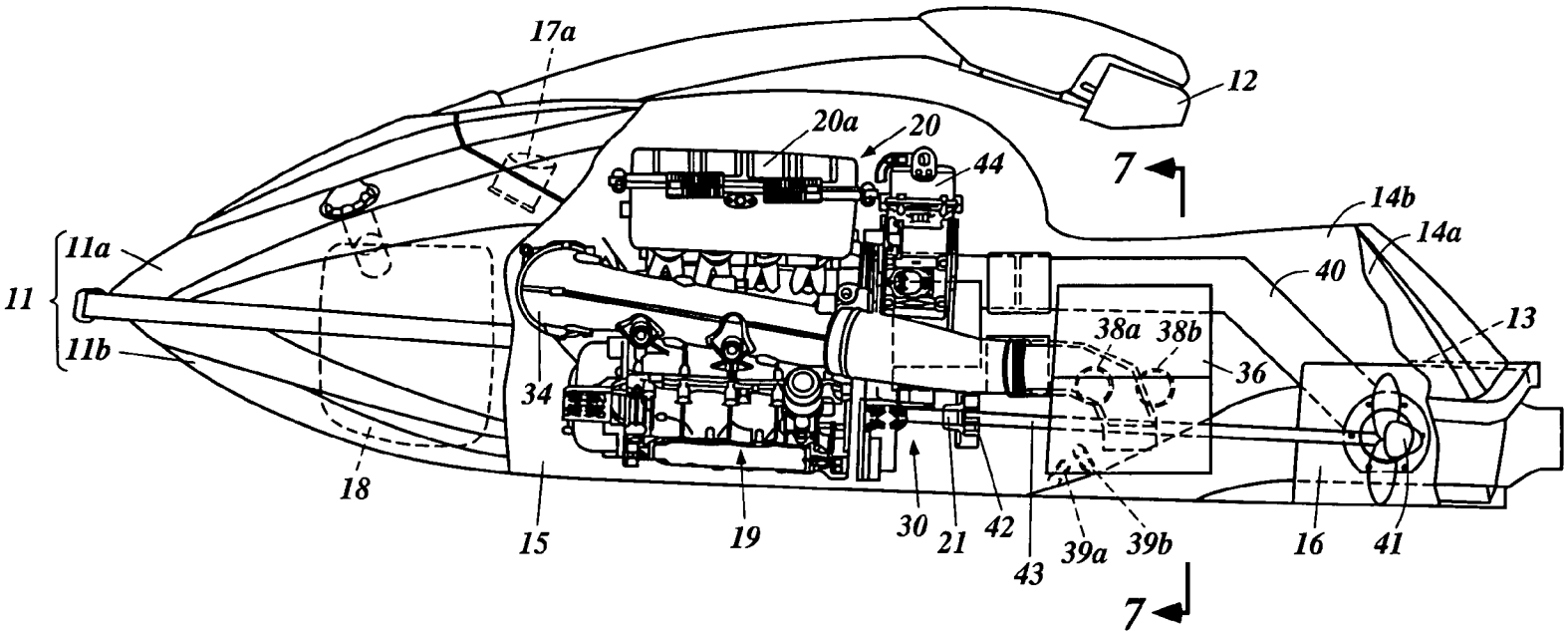
FIG. 2 is a port side elevational and partial cut-away view showing some of the internal components of the watercraft of FIG. 1, including the engine, and portions of the intake and exhaust systems.
Figure 3:
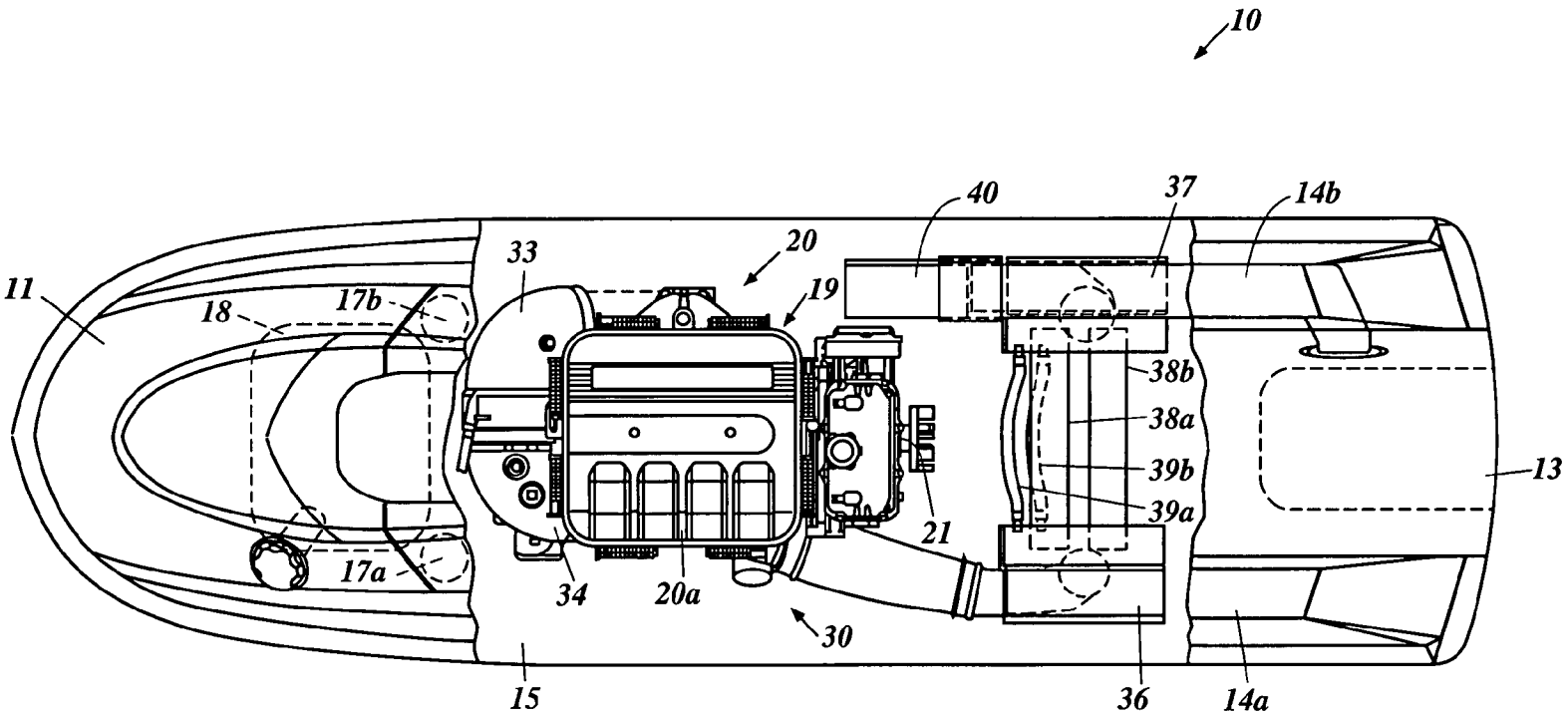
FIG. 3 is a top plan and partial cut-away view of the watercraft shown in FIG. 1.

FIGS. 1–3 show a small jet propulsion watercraft 10 constructed in accordance with at least one embodiment disclosed herein. The small jet propulsion watercraft 10 includes a body 11. The body 11 can comprise a deck 11*a* and a hull 11*b*. The watercraft 10 can also include steering handlebars 12 having a grip generally in the center of the upper part of the body 11, and a stepping platform or "foot tray" 13 composed of a concave portion for an operator to ride on behind the steering handlebars 12. Side wall portions 14*a* and 14*b* are formed on the right and left sides of the stepping platform 13. An operation section including a start switch for starting the small jet propulsion watercraft 10 and the like can be arranged in the vicinity of the steering handlebars 12.

An internal portion of the body 11 can be divided into an engine chamber 15 located in the front and a pump chamber 16 located in the rear. However, other divisions and arrangements can also be used.

Air ducts 17*a* and 17*b* for introducing atmospheric air into the engine chamber 15 can be provided separately at both sides in the front area within the engine chamber 15. These air ducts 17*a* and 17*b* can extend generally vertically from the upper part of the body 11 to the bottom of the engine chamber 15. Additionally, the air ducts 17*a* and 17*b* can be configured to draw in the outside air from their upper end by way of a waterproof structure (not shown) provided on the deck 11*a*, and to introduce the air into the engine chamber 15 from their lower ends.

A fuel tank 18 for storing the fuel can be installed in the front of the watercraft 10, at the bottom of the engine chamber 15. An engine 19 can be installed at about the center and at the bottom of the engine chamber 15.

Figure 4:
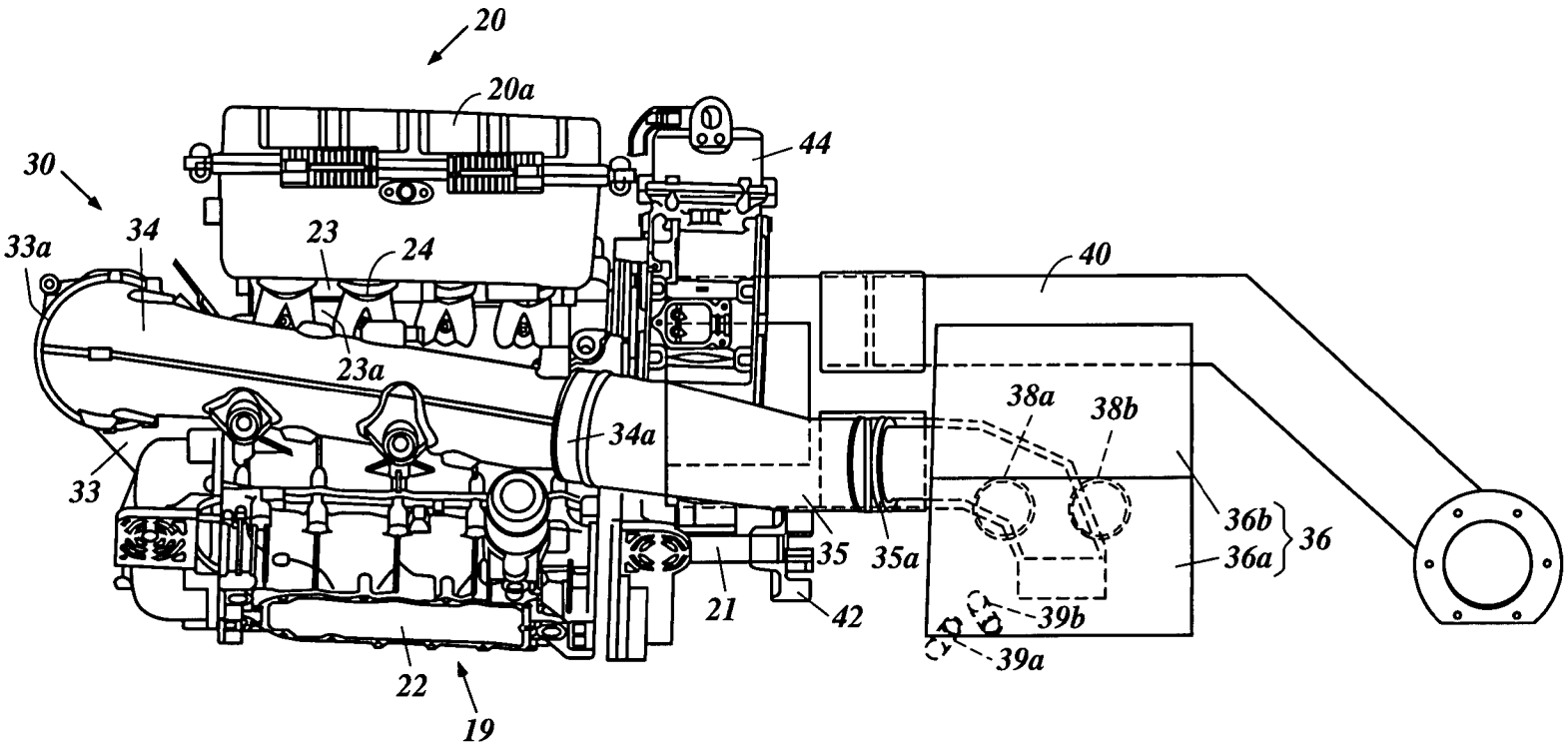
FIG. 4 is a port side elevational view of the engine including the intake and exhaust systems connected to the engine.

An intake system 20 and an exhaust system 30 can be connected to the engine 19. The engine 19 can be a water-cooled, 4-stroke engine having in-line 4 cylinders. However, other types of engines operating on different combustion principles (e.g., 2-stroke, diesel, rotary, etc.), having other numbers of cylinders, and other cylinder arrangements (V-type, W-type, horizontally opposed, etc.) can also be used. As shown in FIG. 4, an outer shell of the engine 19 is composed of a cylinder body 22 in which a crankshaft 21 is housed and a cylinder head 23 formed on top of the cylinder body 22.

Pistons (not shown) joined to the crankshaft 21 are slidably disposed in generally vertical directions within cylinders 23*a*. The cylinders 23*a* are closed at their upper ends by the cylinder head 23. The vertical motions of the pistons are transmitted to the crankshaft 21 and thereby transformed into a rotational motion.

A portion of each cylinder column 24 in the upper part of the cylinder head 23 is provided with an intake valve and an exhaust valve. An intake port communicated with the intake valve of each cylinder column 24 is connected to the intake system 20, while an exhaust port communicated with the exhaust valve is connected to the exhaust system 30. The respective intake valve opens during the intake stroke to feed a gaseous mixture of fuel and air supplied from the intake system 20 to the inside of the cylinder head 23. Similarly, the respective exhaust valve opens during the exhaust stroke to feed the exhaust gas emitted from the cylinder head 23 to the exhaust system 30.

The intake system 20 can comprise an air intake box 20*a*, a throttle body (not shown) disposed within the air intake box 20*a* and the like. The intake system, in the illustrated embodiment, is located generally above the engine 19. The intake system 20 is configured to aspirate the air drawn into the watercraft via the air ducts 17*a* and 17*b*, and to guide the air into the throttle body located on the upper side of the engine 19. The throttle body adjusts the flow rate of the mixture made up of the air that is supplied into each cylinder column 24 and the fuel that is fed from the fuel tank 18 via a fuel system (not shown).

The fuel system can comprise a fuel pump, a fuel injector and the like. However, a carbureted fuel system can also be used. The fuel system can be configured to atomize the fuel from the fuel tank 18 by means of the fuel injector and operation of the fuel pump. The fuel injectors can inject the atomized fuel directly into the cylinder columns 24, into a part of the air intake system 20, or into the intake ports of the engine 19.

The fuel is mixed with the air supplied from the air intake box 20*a* to form an air-fuel mixture. This mixture is fed into the cylinder columns 24.

The engine 19 has an ignition system (now shown), and the air-fuel mixture explodes when it is ignited by the ignition system. The explosion provokes up-and-down movements of the pistons, and the crankshaft 21 is driven rotationally by these movements.

Figure 5:
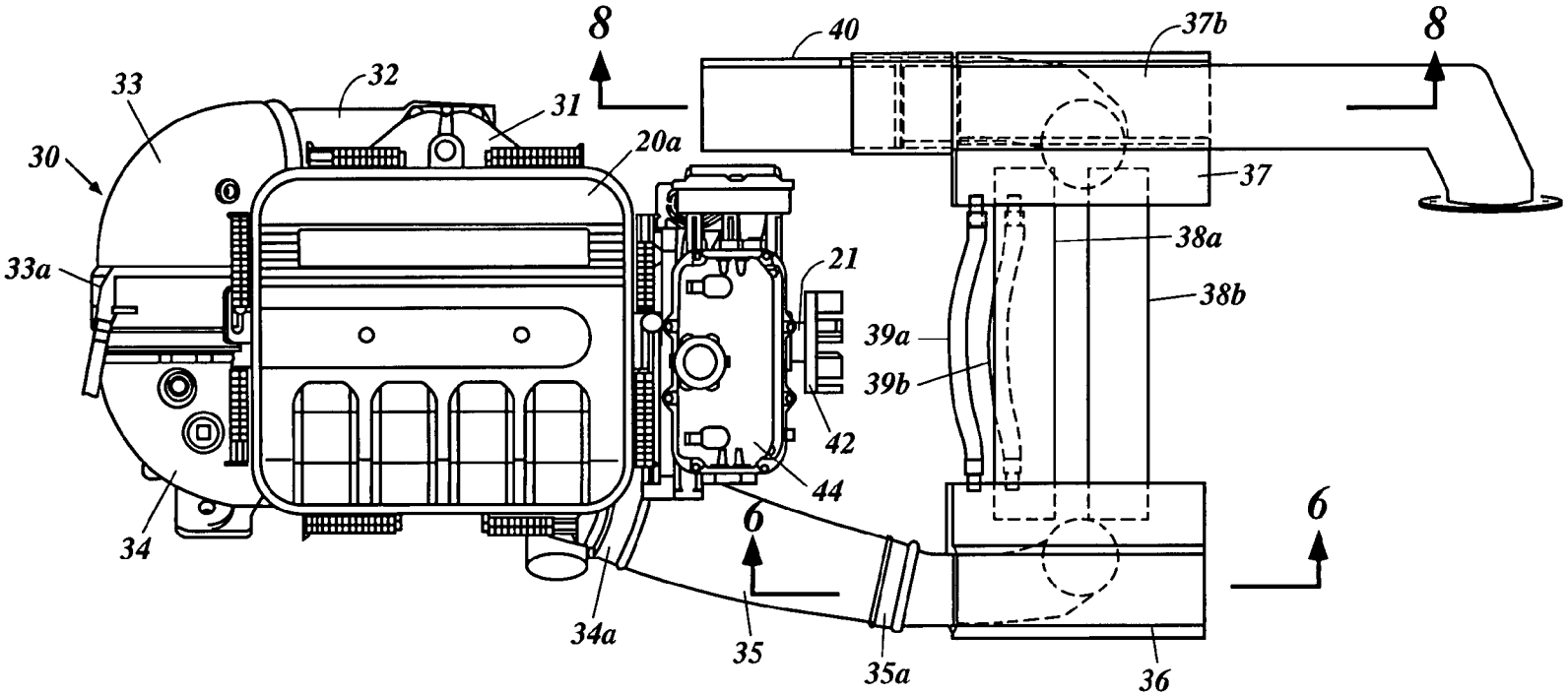
FIG. 5 is a top plan view of the engine.

As shown in FIG. 5, the exhaust system 30 includes an exhaust pipe 31 connected to the exhaust port on each cylinder column 24 through a manifold-type arrangement, a first muffler 32 connected to the downstream end of each exhaust pipe 31, an elbow pipe 33 connected to the first muffler 34, a ring joint 33*a* connected to the downstream end of the elbow pipe 33, a second muffler 34 connected to the downstream end of the ring joint 33*a*, and water lock devices 36 and 37 connected to the downstream end of the second muffler 34 via an exhaust hose 35.

The exhaust pipe 31 extends obliquely downward from its upstream end connected to the exhaust port of the cylinder column 24, while its downstream end is connected to the first muffler 32. The first muffler 32 is disposed along the lower part of the starboard side face of the engine 19, and can be constructed of a double pipe (e.g., concentric pipes) made of aluminum or other heat-resistant materials. The space between the two walls of the double pipe is utilized as a cooling water passage for cooling water. The cooling water passage can be blocked at its rear end (upstream end), and can extend forwardly from the blocked rear end.

The front end of the first muffler 32 reaches a position corresponding to the front end of the engine 19. The downstream end of the first muffler 32 is connected to the elbow pipe 33 which extends through a bend to change the direction of the flow by approximately 90 degrees. The elbow pipe 33 extends obliquely upward as it is bent along the corner of the engine 19, until its downstream end reaches generally the center of the front face of the engine 19.

The second muffler 34 is connected to the downstream end of the elbow pipe 33 via a ring joint 33*a*. The second muffler 34 initially extends obliquely upward along the front face of the engine 19, and then extends rearward along generally the vertical center of the port side face of the engine 19. As with the first muffler 32, the second muffler 34 is constructed of a double pipe which can also be made of aluminum or other heat-resistant materials, and the space between the two walls of the double pipe is used as a cooling water passage. The downstream end of the second muffler 34 is connected to the upstream end of the exhaust hose 35 via a joint 34*a*, and the downstream end of the exhaust hose 35 is connected to the water lock device 36 via a joint 35*a*.

Figure 6:
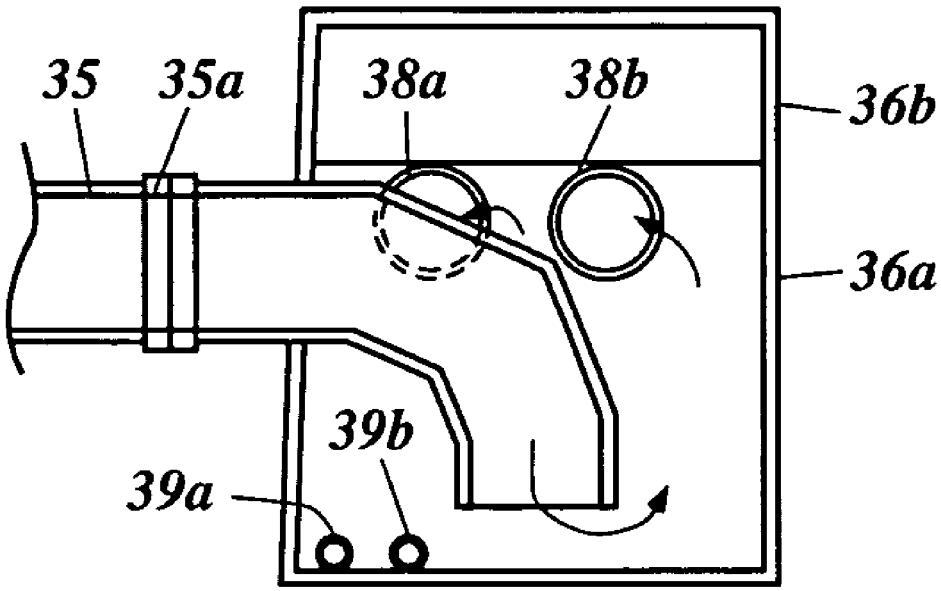
FIG. 6 is a sectional view of a portion of the exhaust system taken along line 6—6 of FIG. 5.
Figure 7:
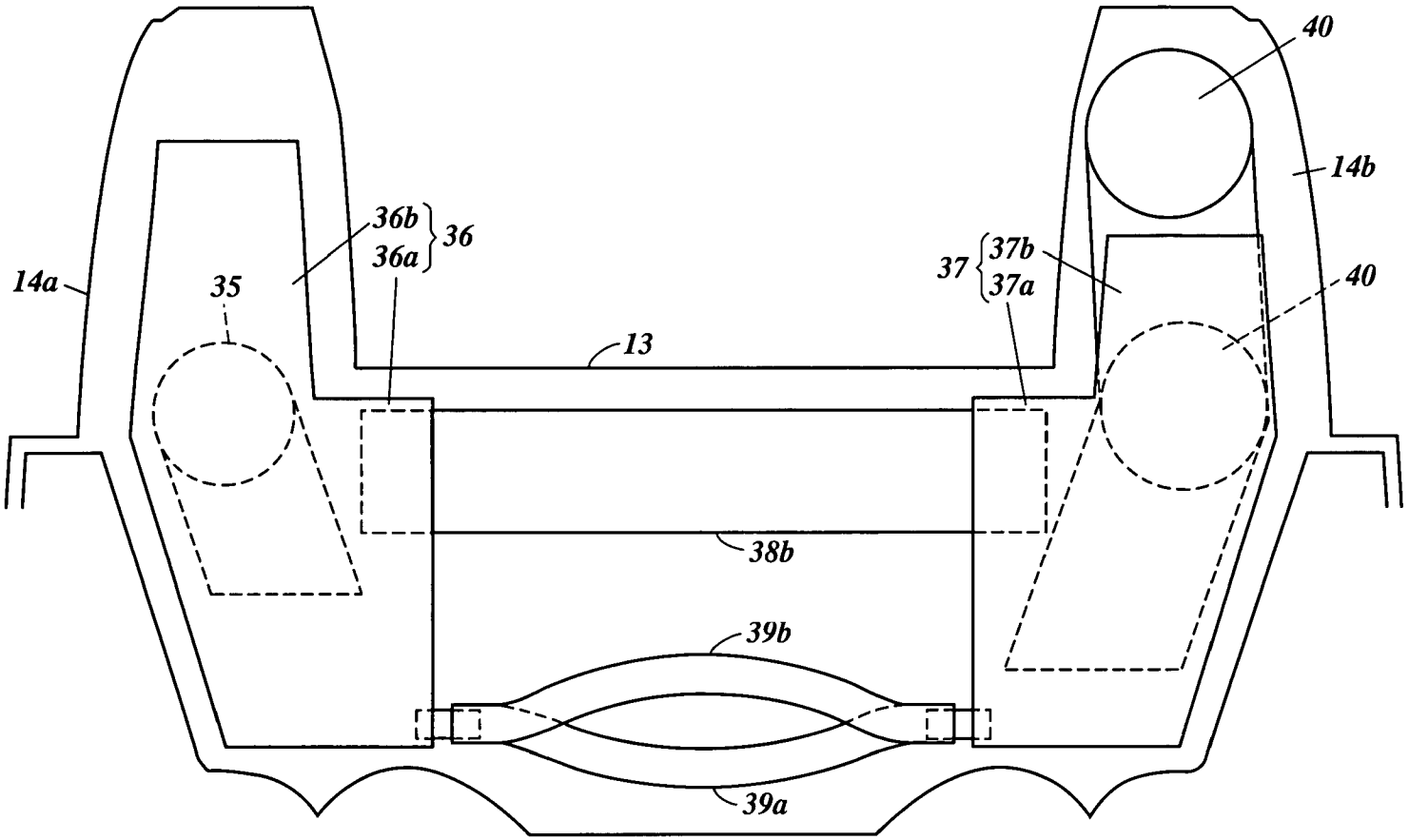
FIG. 7 is a sectional view of the watercraft taken along the line 7—7 of FIG. 2.

The water lock device 36 is installed within the side wall portion 14*a*, constructed by a tank which can have a square or rectangular shape in the plan view as well as in the side view as shown in FIGS. 5 and 6. As shown in FIG. 7, the water lock device 36 can have a generally L-shape with a relatively larger lower part 36*a* and a relatively smaller upper part 36*b*, as viewed from the rear of the watercraft 10. The lower part 36*a* extends to a position in the side wall 14*a* lower than the stepping platform 13, and optionally to a position underneath the stepping platform 13. The upper part 36*b* extends to a position higher than the stepping platform 13.

The water lock device 37 is installed within the side wall portion 14*b*, constructed by a tank which takes a shape that is similar to or the same as the water lock device 36 and can be installed symmetrically. The vertical length of the upper part 37*b* of the device 37 can be shorter than that of the upper part 36*b* of the water lock device 36. A lower part 37*a* of the water lock device 37 is designed to have generally the same size as the lower part 36*a* of the water lock device 36. The lower part 37*a* takes a lower position than the stepping platform 13 in the side wall 14*b*, while the upper part 37*b* takes a higher position than the stepping platform 13.

Optionally, a portion of the lower part 37*a* can be disposed underneath the stepping platform 13.

Optionally, connecting pipes 38*a* and 38*b* can be provided horizontally, extending generally side by side at a portion where the upper end portion of the lower part 36*a* of the water lock device 36 is positioned oppositely to the upper end portion of the lower part 37*a* of the water lock device 37. Small-diameter pipes 39*a* and 39*b* can also be provided in a side by side arrangement at a portion where the front portion of the lower end of the lower part 36*a* of the water lock device 36 is positioned oppositely to the front portion of the lower end of the lower part 37*a* of the water lock device 37.

The small-diameter pipe 39*a* can be arched so that its center is in a relatively lower position, and the small-diameter pipe 39*b* can be arched so that its center is in a relatively higher position. The connecting pipes 38*a* and 38*b* are configured to allow the exhaust gas flowing from the engine 19 side to pass from the water lock device 36 to the water lock device 37. The small-diameter pipe 39*a* and 39*b* are configured to allow the cooling water and intruded seawater flowing into the water lock device 36 to pass to the water lock device 37.

Figure 8:
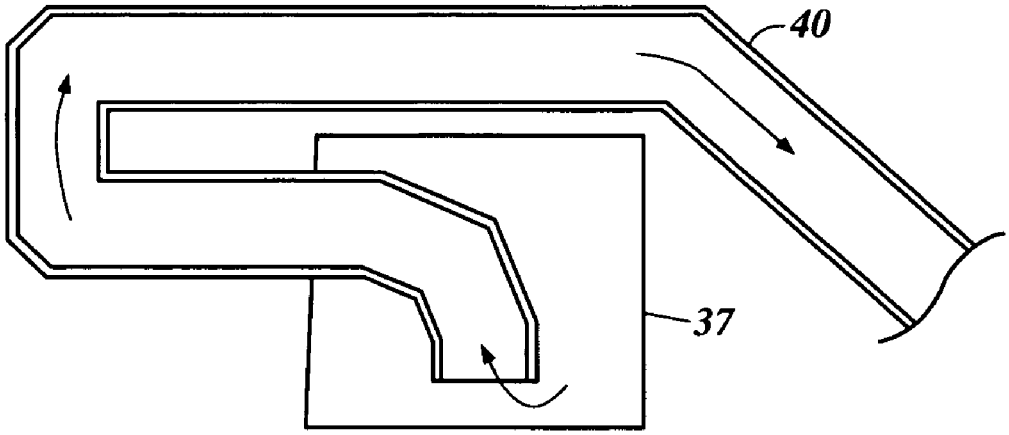
FIG. 8 is a sectional view of another portion of the exhaust system taken along the line 8—8 of FIG. 5.

With reference to FIGS. 5 and 8, an exhaust pipe 40 extends forwardly from about the center of the front of the water lock device 37 (the boundary between the lower part 37*a* and the upper part 37*b*). As shown in FIG. 8, the exhaust pipe 40 initially extends forward, makes an upward bend and then a rearward bend, passes above the water lock device 37 within the side wall portion 14*b*, and extends downward to a position below the stepping platform 13. The downstream end of the exhaust pipe 40 passes through a casing (not shown) for separating the propulsion unit 41 installed in the pump chamber 16 from the main part of the body 11, and is joined with a water jet nozzle of the propulsion unit 41.

On the rear side of the engine 19, an impeller shaft 43 is joined to the crankshaft 21 via a coupling 42. The impeller shaft 43 passes through a casing to extend into the pump chamber 16 located in the rear of the hull 11. The impeller shaft 43 is joined to an impeller provided within the propulsion unit 41 installed at the stern of the body 11. As such, the impeller shaft 43 rotates the impeller by transmitting the rotational force of the crankshaft 21 generated by the operation of the engine 19, to the impeller.

The propulsion unit 41 has a water inlet with its opening located at the bottom of the body 11 and a water jet nozzle with its opening located at the stern. Seawater introduced from the water inlet is ejected from the water jet nozzle by the rotation of the impeller, to generate thrust for the body 11.

The propulsion unit 41 is installed at the bottom at the stern of the body 11, while separated by the aforementioned casing from the main part of the body 11. Thus, the impeller shaft 43 passes through the casing to extend from the engine 19 side of the casing to the propulsion unit 41.

An oil tank 44 is provided at the rear of the engine 19 to supply lubricating oil to the engine 19. The lubricating oil supplied from the oil tank 44 prevents seizure or the like of the engine 19, and allows the engine 19 to achieve smooth operation. The small jet propulsion watercraft 10 also has cooling water passages for cooling the aforementioned systems, especially the exhaust system 30. Besides the aforementioned systems, the small jet propulsion watercraft 10 according to this embodiment has various devices required for the safe operation of the small jet propulsion watercraft 10, such as an electrical equipment box accommodating an electronic control unit including a CPU, a ROM, a RAM, and a timer or the like and various electrical equipment, various types of sensors, and the like.

To run the small jet propulsion watercraft 10 composed as described above, an operator first rides onto the stepping platform 13, crawling on his/her stomach or sitting on his/her heels, and turns on the start switch. This operation makes the small jet propulsion watercraft 10 ready for running. As the operator takes a standing posture, and operates the steering handlebars 12 and a throttle controller provided on the grip of the steering handlebars 12, the small jet propulsion watercraft 10 runs in a given direction at a given speed in accordance with these operations.

At this time, the outside air is drawn into the air intake box 20*a* via the air ducts 17*a* and 17*b*. After passing through the throttle body and the like, the air is mixed with the fuel fed from the fuel tank 18, and the air-fuel mixture is supplied to each cylinder column 24. The air-fuel mixture supplied to each cylinder column 24 explodes within the cylinder column 24 as it is ignited by the ignition system, to drive the engine 19. The rotational force of the crankshaft 21 obtained by the driving force of the engine 19 is transmitted to the impeller shaft 43 for driving the propulsion unit 41.

The exhaust gas generated in the cylinder columns 24 by the explosion of the air-fuel mixture is discharged through the exhaust pipe 31 joined to the exhaust port of each cylinder column 24 into the first muffler 32 installed down below. Then, the exhaust gas is fed from the first muffler 32 into the water lock device 36 by way of the elbow pipe 33, the second muffler 34, and the exhaust hose 35. The exhaust gas is further fed to the water jet nozzle of the propulsion unit 41 via the connecting pipes 38*a* and 38*b*, the water lock device 37, and the exhaust pipe 40. Finally, it is discharged out of the watercraft along with the seawater ejected out of the watercraft from the water jet nozzle.

At this time, the aforementioned systems are cooled by supplying the cooling water through the cooling water passages composed of hoses, to prevent excessive heating. Thus, each system is maintained in proper condition during operation. Seawater is utilized as the cooling water, which is drawn into the watercraft by a jet pump provided at the rear of the body 11. The cooling water drawn into the watercraft by the jet pump is fed to the engine 19, the intake system 20, the first muffler 32 and the second muffler 34 of the exhaust system 30, the oil tank 44, and the like via the hoses to cool down such devices.

The cooling water is discharged from a given portion after cooling the devices, and some of the cooling water is discharged out of the watercraft after passing through the exhaust hose 35, the water lock device 36, and the like. In this case, the cooling water having entered the water lock device 36 flows through the small-diameter pipes 39*a* and 39*b* to the water lock device 37. Then, in the water lock device 37, the cooling water is mixed with the exhaust gas flowing in through the connecting pipes 38*a* and 38*b* to be transformed into vapor, and flows through the exhaust pipe 40 to the water jet nozzle of the propulsion unit 41.

The exhaust pipe 40 extends upward from the water jet nozzle of the propulsion unit 41 to above the water lock device 37, and then communicates with the water lock device 37 at its front face. Thus, seawater is not likely to flow in reverse from the water jet nozzle to enter the water lock device 37 when the small jet propulsion water craft 10 is in a normal running condition. In case the small jet propulsion watercraft 10 is capsized while running, the water jet nozzle of the propulsion unit 41 is positioned at higher level than the other portions, making it difficult for the seawater to enter the exhaust pipe 40.

In case the seawater enters the exhaust pipe 40 while the body 11 is being turned right-side up (also known as "righting") after having been capsized, the seawater intrusion will be stopped at the water lock device 37, preventing the intrusion of the seawater to the vicinity of the engine 19, because the connecting pipes 38*a* and 38*b* to connect the water lock devices 36 and 37 come to a higher position. Thus, no unfavorable running condition due to the seawater intrusion to the vicinity of the engine 19 will take place on the small jet propulsion watercraft 10, and favorable running condition can be maintained.

As described above, in the small jet propulsion watercraft 10 according to this embodiment, the water lock devices 36 and 37 are not provided in the engine chamber 15 or in the pump chamber 16, but within the side wall portions 14*a* and 14*b*, respectively, increasing vacant space in the engine chamber 15 or in the pump chamber 16. Thus, the capacity of the fuel tank 18 can be increased. In addition, the number of components installed in the engine chamber 15 or in the pump chamber 16 can be increased, or the layout of the components such as electrical equipment box and the oil tank 44 can be altered flexibly. In this case, it is also practicable to maintain a larger gap between the devices to restrict heat conduction, or to install a heat insulation material between the devices.

The two water lock devices 36 and 37 are installed within the side wall portions 14*a* and 14*b*, respectively, separated from each other. Thus, when the small jet propulsion watercraft 10 rolls or capsizes and the water lock device 36 is located below the water surface, the water lock device 37 is located above the water surface, preventing the seawater from entering the water lock device 37. When the water lock device 37 is located below the water surface, on the contrary, the water lock device 36 is located above the water surface, preventing the seawater from entering the water lock device 36. Thus, the seawater intrusion will be stopped at the water lock device 37, preventing the intrusion of the seawater to the vicinity of the engine 19.

Since the connecting pipes 38*a* and 38*b* are located below the stepping platform 13, the connecting pipes 38*a* and 38*b* are located at higher level when the small jet propulsion watercraft 10 is inverted. Thus, it is difficult for the seawater to flow from the water lock device 36 to the water lock device 37, or from the water lock device 37 to the water lock device 36. Consequently, the intrusion of the seawater to the vicinity of the engine 19 is prevented securely even when the small jet propulsion watercraft 10 is capsized. Further, since the connecting pipes 38*a* and 38*b* are composed of two pipes, the vertical dimension of the space for the installation of the connecting pipes 38*a* and 38*b* can be designed to be smaller, and consequently there is no need to raise the height of the stepping platform 13.

The exhaust pipe 40 is formed in a complicated shape, that is, the exhaust pipe initially extends forward from the front face of the water lock device 37, extends upward and then rearward, passes above the water lock device 37 within the side wall portion 14*b*, and further extends into the pump chamber 16 provided below the stepping platform 13. Thus, even when the seawater enters the exhaust pipe 40, the seawater cannot intrude into the water lock device 37 by way of the exhaust pipe 40. Therefore, the intrusion of seawater into the vicinity of the engine 19 is prevented more reliably. Since not only the water lock device 37 but also the major part of the exhaust pipe 40 is installed within the side wall portion 14*b*, extra room is created in the engine chamber 15 and in the pump chamber 16, allowing the effective utilization of the vacant space.

The small-diameter pipes 39*a* and 39*b* are provided in the lower end portion of the water lock devices 36 and 37 for feeding out the cooling water. This allows the effective discharge of the cooling water entering the water lock device 36. It also allows the effective discharge of the seawater along with the exhaust gas when the seawater intrudes into the water lock device 36 from the water lock device 37. In addition, with the small-diameter pipe 39*a* making a downward arch and the small-diameter pipe 39*b* making an upward arch, effective water discharge is obtained at any time regardless of the slanting angle of the small jet propulsion watercraft 10.

With this arrangement, cooling water (seawater) for cooling the engine 19, the exhaust system 30 and the like can be discharged out of the watercraft 10 from the water lock devices 36, 37. In this case, the cooling water can be discharged to the downstream side of the water lock devices 36, 37 via the small-diameter pipe 39*a* 39*b* when the exhaust pressure within the water lock devices 36, 37 becomes higher by the exhaust gas emitted from the engine 19. The exhaust gas is discharged to the downstream water lock device 37 via the connecting pipes 38*a*, 38*b*, and the cooling water is mixed with the exhaust gas in the downstream water lock device 37. Then, the cooling water turns into a generally gaseous state, and is discharged out of the watercraft with the exhaust gas.

Seawater can also be discharged to the downstream side of the water lock devices 36, 37 via the small-diameter pipes 39*a*, 39*b* in the same manner even when it intruded into the water lock devices 36, 37. In this manner, the cooling water and seawater entering the water lock devices 36, 37 can be discharged effectively. In this case, clogging in the connecting pipes 38*a*, 38*b* caused by the bubbles of a seawater/exhaust gas mixture is prevented. This in turn prevents a problem that the normal engine output cannot be attained owing to the clogging. That is, appropriate engine output can be obtained by passing the seawater through the small-diameter pipes 39*a*, 39*b* while passing the exhaust gas through the connecting pipes 38*a*, 38*b*.

A small jet propulsion watercraft according to this invention is not limited to the aforementioned embodiment, but can be altered for implementation as deemed to be appropriate. For instance, the aforementioned small jet propulsion watercraft 10 includes two water lock devices 36 and 37, but the water lock device may be provided in only one of the side wall portions 14*a* and 14*b*. In case the water lock device is provided only within the side wall portion 14*a*, the water lock device can be shaped to have a relatively small upper part like that of the water lock device 37, so that the exhaust pipe can be installed above the water lock device within the side wall portion 14*a*.

In this case, the connecting pipes 38*a* and 38*b* or the small-diameter pipes 39*a* and 39*b* can be omitted. Also, it is practicable to provide the water lock device 37 only within the side wall portion 14*b*. In this case, the side wall portion 14*a* may be filled with a foaming agent, or other components may be installed within the side wall portion 14*a*. In addition, the number of connecting pipes 38*a* and 38*b*, or small-diameter pipes 39*a* and 39*b*, does not need to be two, but may be only one, or may be a plural number such as three (3) or larger. The composition of other portions may be altered, too, for implementation within the technical scope of the inventions disclosed herein.

What is claimed is:

1. A small jet propulsion watercraft having an engine and a body configured to be operable by an operator riding on a stepping platform provided at a rear of the body, the body including left and right side wall portions extending upwardly and disposed at both left and right sides of the stepping platform, a first water lock device, a second water lock device, wherein the water lock devices are configured to guide exhaust gas to an exterior of the watercraft from an exhaust port of the engine and the water lock devices are at least partially disposed within the left and right side wall portions, and a connecting pipe assembly located directly beneath the stepping platform and connecting the water lock devices, wherein the first and second water lock devices are connected by a small-diameter pipe at a position lower than a position where the connecting pipe assembly is connected to the first and second water lock devices.

2. A small jet propulsion watercraft having an engine and a body configured to be operable by an operator riding on a stepping platform provided at a rear of the body, the body including left and right side wall portions extending upwardly and disposed at both left and right sides of the stepping platform, and at least a first water lock device configured to guide exhaust gas to an exterior of the watercraft from an exhaust port of the engine, the first water lock device being provided within at least one of the left and right side wall portions, wherein an exhaust pipe is connected to a downstream side of the water lock device in a direction of flow of exhaust gas, the exhaust pipe extending initially forward from a front end of the water lock device, extending upward and then rearward, passing above the water lock device within the at least one of the left and right side wall portions, and further extending downward toward a position lower than the stepping platform.

3. The small jet propulsion watercraft according to claim 1, wherein the connecting pipe assembly comprises a plurality of pipes disposed side by side.

4. A small jet propulsion watercraft having an engine and a body configured to be operable by an operator riding on a stepping platform provided at a rear of the body, the body including left and right side wall portions extending upwardly and disposed at both left and right sides of the stepping platform, and at least a first water lock device configured to guide exhaust gas to an exterior of the watercraft from an exhaust port of the engine, the first water lock device being provided within at least one of the left and right side wall portions, additionally comprising a second water lock device, wherein the first and second water lock devices are provided in the left and right side wall portions, respectively, the first and second water lock devices being connected by a connecting pipe assembly located below the stepping platform, and additionally comprising first and second lateral pipes connecting the first and second water lock devices, the first lateral pipe being arched upwardly, the second lateral pipe being arched downwardly.

5. The small jet propulsion watercraft according to claim 4, wherein the connecting pipe assembly comprises a plurality of connecting pipes disposed above the lateral pipes.

6. The small just propulsion watercraft according to claim 1, wherein the connecting pipe assembly is located rearwardly from the front of either of the first and second water lock devices.

* * * * *

UNITED STATES PATENT AND TRADEMARK OFFICE

CERTIFICATE OF CORRECTION

PATENT NO. : 7,140,935 B2
APPLICATION NO. : 10/967516
DATED : November 28, 2006
INVENTOR(S) : Yoshiki Futaki It is certified that error appears in the above-identified patent and that said Letters Patent is hereby corrected as shown below:

At column 1, line 50, after “problem” please insert -- in --.

At column 1, line 61, after “problem” please insert -- in --.

At column 2, line 41 (approx.), please delete “a” and insert -- as --, therefore.

At column 4, line 8, please delete “34,” and insert -- 32, --, therefore.

At column 10, line 25, in claim 6, please delete “just” and insert -- jet --, therefore.

Signed and Sealed this

Second Day of September, 2008

JON W. DUDAS
*Director of the United States Patent and Trademark Office*